US009117608B2

(12) United States Patent
Nakada et al.

(10) Patent No.: US 9,117,608 B2
(45) Date of Patent: Aug. 25, 2015

(54) SWITCHGEAR

(75) Inventors: Katsushi Nakada, Tokyo (JP); Katsuhiko Horinouchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 40 days.

(21) Appl. No.: 13/824,586

(22) PCT Filed: Aug. 26, 2011

(86) PCT No.: PCT/JP2011/069283

§ 371 (c)(1), (2), (4) Date: Apr. 5, 2013

(87) PCT Pub. No.: WO2012/093507

PCT Pub. Date: Jul. 12, 2012

(65) Prior Publication Data

US 2013/0270228 A1 Oct. 17, 2013

(30) Foreign Application Priority Data

Jan. 7, 2011 (JP) ..... 2011-001572

(51) Int. Cl.
*H01H 33/65* (2009.01)
*H01H 33/12* (2006.01)
(Continued)

(52) U.S. Cl.
CPC ..... *H01H 33/62* (2013.01); *H01H 33/12* (2013.01); *H01H 33/182* (2013.01); *H01H 33/703* (2013.01); *H01H 33/7046* (2013.01); *H01H 33/91* (2013.01); *H01H 2033/906* (2013.01)

(58) Field of Classification Search
CPC ..... H01H 2033/906; H01H 33/62; H01H 33/703; H01H 33/91
USPC ..... 218/40, 63–65
See application file for complete search history.

(56) References Cited

U.S. PATENT DOCUMENTS 4,381,436 A * 4/1983 Nagaoka et al. ..... 218/65
4,560,848 A 12/1985 Arimoto
(Continued)

FOREIGN PATENT DOCUMENTS

EP 1276125 A2 1/2003
FR 1 500 340 A 11/1967
(Continued)

OTHER PUBLICATIONS

Chinese Office Action dated Dec. 10, 2014, issued in Chinese Patent Application No. 201180053688.4 (with English translation).
(Continued)

*Primary Examiner* — Truc Nguyen
(74) *Attorney, Agent, or Firm* — Oblon, McClelland, Maier & Neustadt, L.L.P.

(57) ABSTRACT

A switchgear includes a fixed contactor provided in a tank filled with insulating gas, and a movable contactor provided in the tank, the movable contactor being connected to and disconnected from the fixed contactor so as to move forward and backward. The switchgear includes an arc extinction member including a surrounding portion which is slidably connected to the outer circumferential surface of the movable contactor halfway in a movement range from a close contact state to an open contact state and is formed so as to surround an arc space portion in a sealed manner, the surrounding portion being formed with a through hole through which the arc space communicates with the outside of the arc space.

20 Claims, 11 Drawing Sheets

(51) Int. Cl.

| | |
|---|---|
| ***H01H 33/70*** | (2006.01) |
| ***H01H 33/91*** | (2006.01) |
| ***H01H 33/18*** | (2006.01) |
| *H01H 33/90* | (2006.01) |

(56) References Cited

U.S. PATENT DOCUMENTS

| | | | | |
|---|---|---|---|---|
| 5,231,256 | A * | 7/1993 | Yamagiwa et al. | 218/63 |
| 5,510,591 | A * | 4/1996 | Tremblay et al. | 218/43 |
| 5,514,844 | A * | 5/1996 | Hamano et al. | 218/57 |
| 5,750,949 | A * | 5/1998 | Rees et al. | 218/43 |
| 5,814,781 | A * | 9/1998 | Koyanagi et al. | 218/60 |
| 5,844,189 | A * | 12/1998 | Niemeyer | 218/29 |
| 6,624,371 | B2 * | 9/2003 | Dufournet et al. | 218/61 |
| 8,664,558 | B2 * | 3/2014 | Bose | 218/51 |
| 2001/0035395 | A1 * | 11/2001 | Dufournet | 218/43 |
| 2002/0113040 | A1 * | 8/2002 | Imamura et al. | 218/43 |
| 2002/0117475 | A1 * | 8/2002 | Dufournet et al. | 218/43 |
| 2008/0314873 | A1 * | 12/2008 | Dahlquist et al. | 218/53 |

FOREIGN PATENT DOCUMENTS

| | | | |
|---|---|---|---|
| FR | 1500340 | A | 11/1967 |
| JP | 6 9029 | | 2/1994 |
| JP | 2003-346611 | A | 12/2003 |
| JP | 2008 218001 | | 9/2008 |

OTHER PUBLICATIONS

Extended European Search Report issued Nov. 14, 2014 in Patent Application No. 11854626.6.

Chinese Office Action dated Jun. 10, 2015, issued in Chinese Patent Application No. 201180053688.4.

* cited by examiner

SWITCHGEAR

TECHNICAL FIELD

The present invention relates to a switchgear such as a disconnecting switch and/or a circuit breaker which opens or closes an electrical path in an electric power system, and, more particularly, relates to an improvement in arc extinguishing performance.

BACKGROUND ART

For example, in a disconnecting switch and/or a circuit breaker which interrupts current in insulating gas such as SF6 gas and dry air, as a technique which interrupts an arc generated between electrodes during current interruption, there is a method in which arc extinguishing gas generated from an arc extinction member and the arc cooled by the arc extinguishing gas; and accordingly, the arc is interrupted. This is a method in which the arc extinction member is disposed near an arc generation portion of a fixed electrode or a movable electrode and the arc comes into contact with the arc extinction member; and accordingly, the arc is cooled by the arc extinguishing gas generated from the arc extinction member.

As such a known switchgear, an arc generated between a fixed contact and a movable contact and between a current-carrying contact and the movable contact to interrupt the arc by decoupling, and the arc generated between the current-carrying contact and the movable contact is brought into contact with a fluorine resin tube; and accordingly, arc extinguishing gas is made to generate and to improve interruption performance (see, for example, Patent Document 1).

RELATED ART DOCUMENT

Patent Document

Patent Document 1: Japanese Unexamined Utility Model Publication No. H6-9029 (Page 1, FIG. 1)

SUMMARY OF THE INVENTION

Problems to be Solved by the Invention

In the above-described known switchgear, the arc extinction member generates the arc extinguishing gas by being melted by the heat of the arc. However, the amount of generation of arc extinguishing gas changes depending on the melting temperature of the arc extinction member and the coefficient of thermal conductivity of insulation gas. In order to surely generate arc extinguishing gas, what is important is to bring the arc into contact with the arc extinction member.

In the known art such as Patent Document 1, no means exists to control the extending direction of the arc toward the arc extinguishing member side; and therefore, there is no certainty that the arc comes into contact with the arc extinction member, the arc extinguishing gas is likely not to be generated, and the generation of the arc extinguishing gas is unstable.

The present invention has been made to solve the above described problem, and an object of the present invention is to provide a switchgear in which the extending direction of an arc is controlled in the direction of the surface of an arc extinction member by a pressure gradient in connection with the generation of the heat of the arc and arc extinguishing gas, and interruption performance is improved by the stable generation of the arc extinguishing gas.

Means for Solving the Problems

According to the present invention, there is provided a switchgear including: a fixed contactor provided in a tank filled with insulating gas; and a movable contactor provided in the tank, the movable contactor being connected to and disconnected from the fixed contactor so as to move forward and backward. The switchgear includes an arc extinction member including a surrounding portion which is slidably connected to the outer circumferential surface of the movable contactor halfway in a movement range from a close contact state to an open contact state, and is formed so as to surround an arc space portion in a sealed manner, the surrounding portion being formed with a through hole through which the arc space communicates with the outside of the arc space.

Furthermore, according to the present invention, there is provided a switchgear including: a fixed contactor provided in a tank filled with insulating gas; and a movable contactor provided in the tank, the movable contactor being connected to and disconnected from the fixed contactor so as to move forward and backward. The switchgear includes: an arc extinction member having a surrounding portion which is slidably connected to the outer circumferential surface of the movable contactor halfway in a movement range from a close contact state to an open contact state, and is formed so as to surround an arc space portion in a sealed manner; and an arc extinguishing member provided in a central portion of the movable contactor, the arc extinguishing member being formed with a center hole axially formed in a central portion of the arc extinguishing member.

Advantageous Effect of the Invention

According to the present invention, an arc space communicates with the outside of the arc space by a through hole formed in a surrounding portion of an arc extinction member, thereby being capable of controlling the extending direction of an arc so as to be surely brought into contact with the arc extinction member, whereby arc extinguishing gas is stably generated and arc extinguishing performance of a switchgear can be improved.

MODE FOR CARRYING OUT THE INVENTION

Embodiment 1

Figure 1:
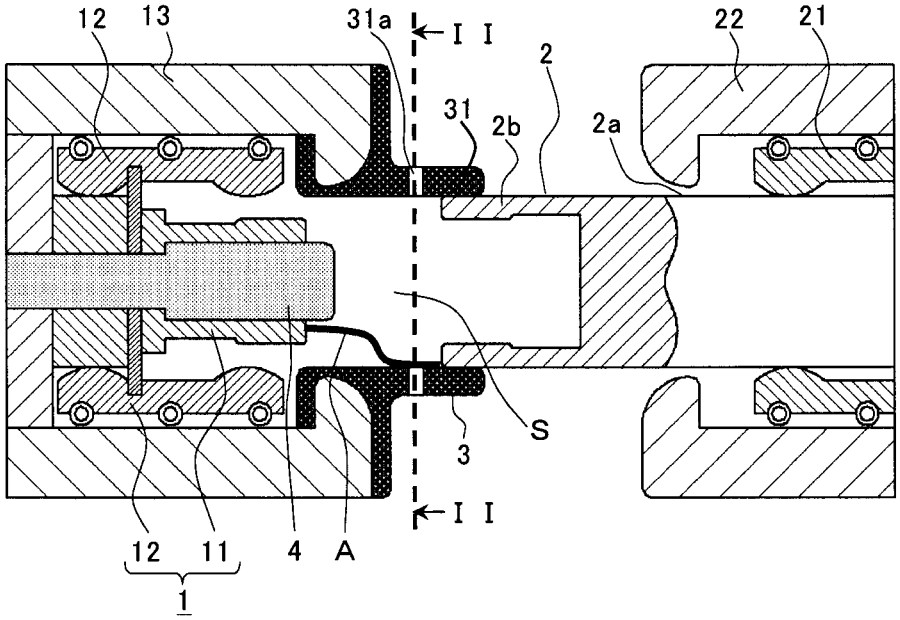
FIG. 1 is a sectional view conceptually showing a major portion of a switchgear according to Embodiment 1 of the present invention.

Hereinafter, a switchgear according to Embodiment 1 of the present invention will be described with reference to FIG. 1, FIG. 2, FIG. 6, FIG. 7, and FIG. 8. FIG. 1 is a sectional view conceptually showing a major portion of the switchgear according to Embodiment 1 of the present invention. FIG. 1 shows an arc extinction chamber placed in a tank (not shown in the drawing) filled with insulating gas and the vicinity thereof. In the drawings, a fixed contactor 1 of the switchgear is a cylindrical shape having a finger shape in longitudinal section provided in a central portion; and the fixed contactor 1 is composed of a fixed arc contact 11 in which an arc is generated during contact opening and a fixed main contact 12 concentrically disposed so as to form a tubular shape via a gap on an outer circumferential portion of the fixed arc contact 11. A fixed side shield 13 for electric field relaxation is placed so as to surround the fixed main contact 12.

A movable contactor 2 is connected to and disconnected from the fixed contactor 1 by moving forward and backward in the horizontal direction of the drawing by a driving device (not shown in the drawing). A plurality of tubular shaped current collectors 21 are disposed around the movable contactor 2 and are always slidably connected to the outer circumferential surface 2*a* thereof with respect to axial movement of the movable contactor 2. An outer circumferential portion of the current collector 21 is surrounded by a movable side shield 22 for electric field relaxation. A leading end portion of the movable contactor 2 on the fixed contactor 1 side constitutes a contact portion 2*b* formed in a tubular shape; and the contact portion 2*b* goes into between the fixed arc contact 11 and the fixed main contact 12 of the fixed contactor 1 in a close contact state of the switchgear and is electrically connected with a predetermined contact pressure by the fixed main contact 12.

An arc extinction member 3 constituting the arc extinction chamber is fixed to the fixed side shield 13 and has a surrounding portion 31 which is slidably connected to the outer circumferential surface 2*a* of the movable contactor 2 halfway in a movement range from a close contact state to an open contact state, the surrounding portion 31 being formed so as to surround an arc space portion S in a sealed manner. Then, the surrounding portion 31 of the arc extinction member 3 is formed with a plurality of through holes 31*a* (in this example, two vertically symmetric positions of the drawing) at predetermined portions, the through holes 31 being provided for deflecting the extending direction of a generated arc A by a pressure gradient.

Figure 9:
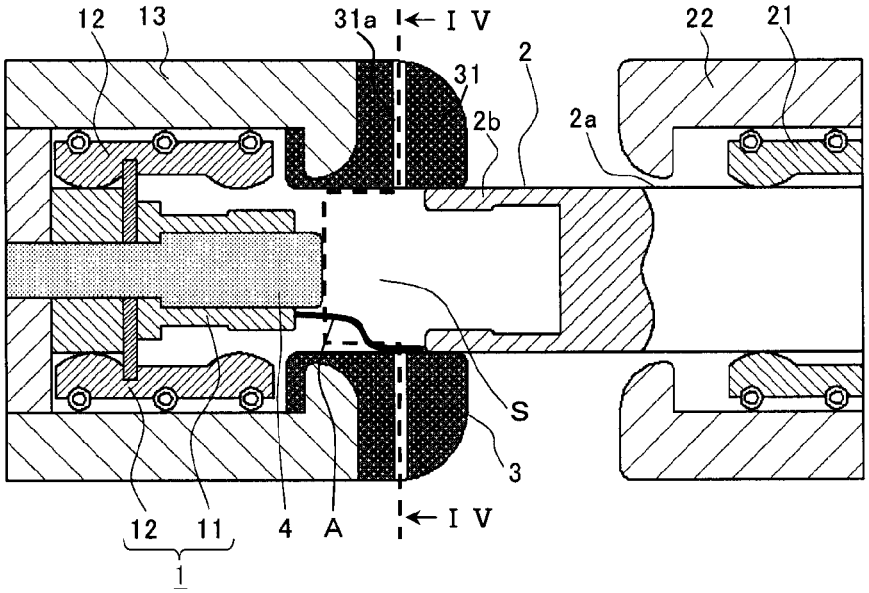
FIG. 9 is a sectional view conceptually showing a major portion of a switchgear using a toroidal arc extinction member according to Embodiment 1.
Figure 10:
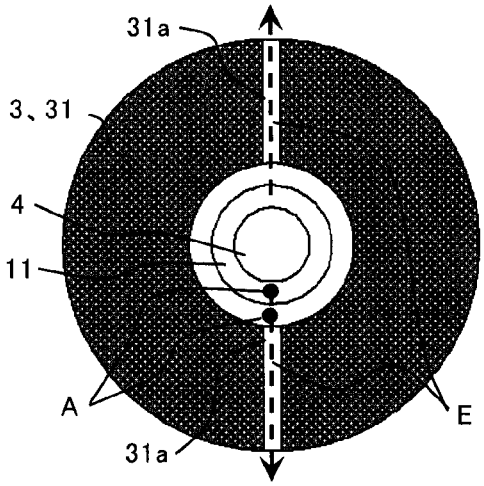
FIG. 10 is a sectional view as viewed along the line IV-IV in FIG. 9.

Incidentally, the shape of the arc extinction member 3 may be formed in a cylindrical shape as shown in FIG. 1 or may be formed in a toroidal shape as shown in FIG. 9 and FIG. 10. If in the case of the toroidal shape as shown in FIG. 9, a portion to be cut for manufacturing is minimized; and therefore, processing cost can be inexpensive.

Incidentally, the number of the through holes 31*a* and their circumferential placing positions are not particularly limited, but it is permissible if the arc A can be extended in the direction of the wall surface of the surrounding portion 31 by the pressure gradient which is generated in connection with the generation of the arc A and lowers from the center side of the arc space portion S toward the wall surface side of the surrounding portion 31, at least one place; and the through holes 31*a* do not also need to be arranged in a line-symmetric manner.

Figure 11:
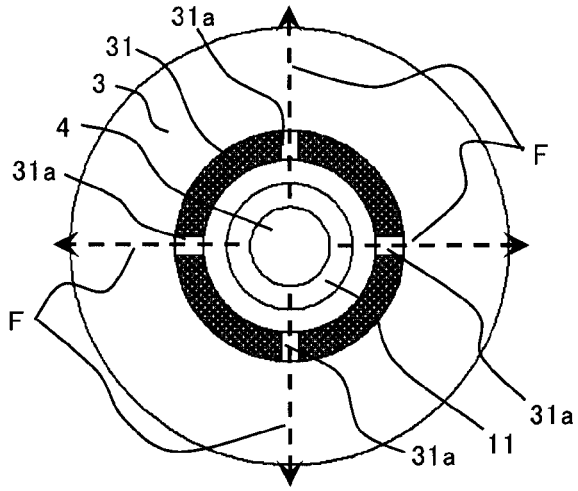
FIG. 11 is a sectional view conceptually showing a major portion of a switchgear in the case of four through holes according to Embodiment 1.

FIG. 11 is an example in which the through holes 31*a* are formed in a vertically and bilaterally symmetric manner. The numbers of the through holes 31*a* are increased as shown in FIG. 11; and accordingly, it is susceptible to pressure even when the arc A exists at any position in the arc space portion S and thus the arc easily comes into contact with the wall inner surface of the surrounding portion 31.

Incidentally, the arc space portion S includes spaces formed inside the surrounding portion 31 of the arc extinction member 3 and the tubular shaped contact portion 2*b* of the movable contactor 2.

Figure 12:
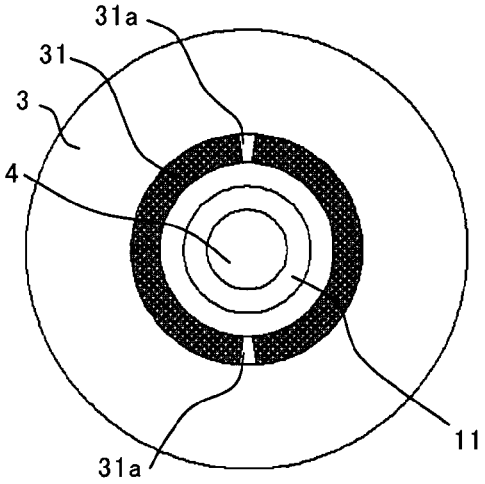
FIG. 12 is a sectional view conceptually showing a major portion of a switchgear having different diameters at the inner circumferential surface and the outer circumferential surface of a through hole according to Embodiment 1.

Furthermore, the through hole 31*a* may be formed such that the diameter of the outer circumferential surface side of the surrounding portion 31 of the arc extinction member 3 is larger than the diameter of the inner circumferential surface side of the surrounding portion 31 of the arc extinction member 3, as shown in FIG. 12. It is possible that the smaller in diameter of the inner circumferential surface side of the surrounding portion 31 of the arc extinction member 3 it is, the higher in pressure of the arc space portion S it will obtain; and the larger in diameter of the outer circumferential surface side of the surrounding portion 31 of the arc extinction member 3 it is, the faster in the flow of gas in connection with the generation of the arc A it will be. Thus, it becomes possible to bring the arc A into contact with the arc extinction member 3 more easily.

Further, a columnar arc extinguishing member 4 is provided in the inside of the fixed arc contact 11 so as to protrude from an opening end portion of the fixed arc contact 11 toward the separating direction of the movable contactor 2. Incidentally, the arc extinguishing member 4 may be located at the same surface position as the opening end of the fixed arc contact 11; but preferably, the arc extinguishing member 4 is protruded toward the separating direction of the movable contactor 2, that is, toward the arc space portion 5, as shown in FIG. 1. In addition, in the case of protruding the arc extinguishing member 4, an insulation distance in which an arc flash does not occur between the protruding end portion of the arc extinguishing member 4 and the movable contactor 2 or between the protruding end portion and the movable side shield 22 has to be ensured in an open contact state of the movable contactor 2.

As a material that can be preferably used for the arc extinction member 3 and the arc extinguishing member 4, there can be included those combined with any one or a plurality of kinds of, for example, polytetrafluoroethylene, polyacetal, acrylic acid ester copolymer, aliphatic hydrocarbon resin, polyvinyl alcohol, polybutadiene, polyvinyl acetate, polyvinyl acetal, isoprene resin, ethylene-propylene rubber, ethylene-vinyl acetate copolymer, and polyamide resin.

Incidentally, the same material may be used for the arc extinction member 3 and the arc extinguishing member 4, or the materials of these members may be different from each other. In addition, for example, in the case of a three phase alternating current, the similarly configured switchgears, each shown in FIG. 1, are provided in the required number according to the number of phases or the like, and are arranged side by side with a predetermined distance spaced from each other.

Figure 2:
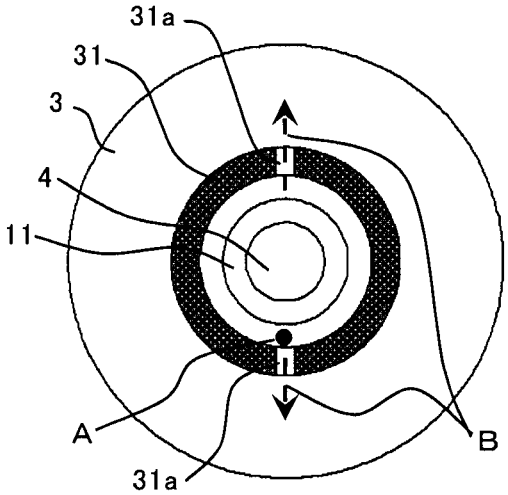
FIG. 2 is a sectional view as viewed along the line II-II in FIG. 1.
Figure 6:
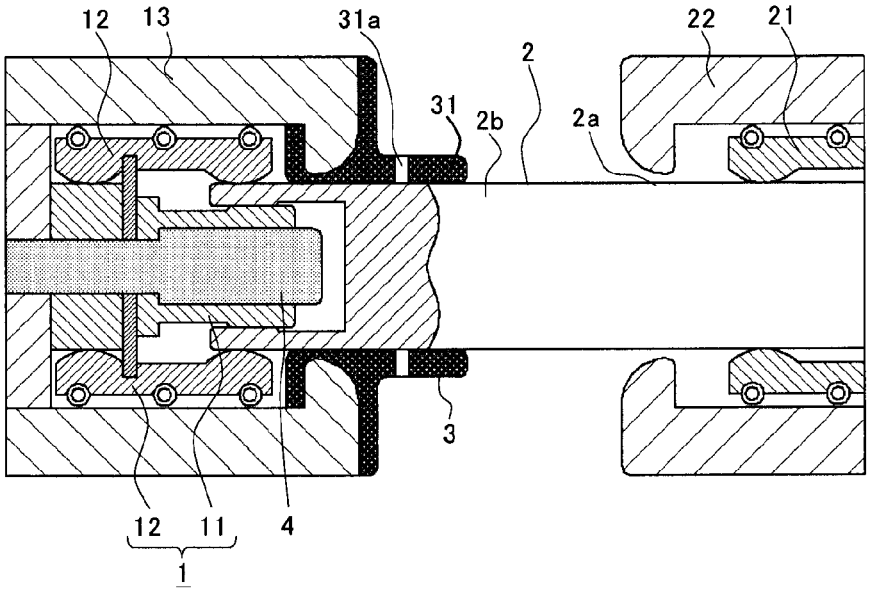
FIG. 6 is a sectional view showing a close contact state of Embodiment 1 of the present invention.
Figure 7:
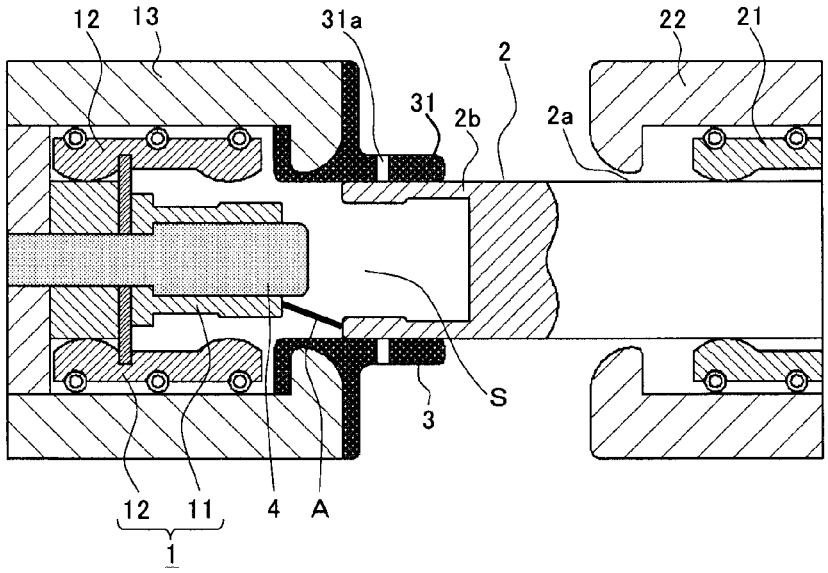
FIG. 7 is a sectional view showing a halfway open contact state at the time when an arc is generated in Embodiment 1.
Figure 8:
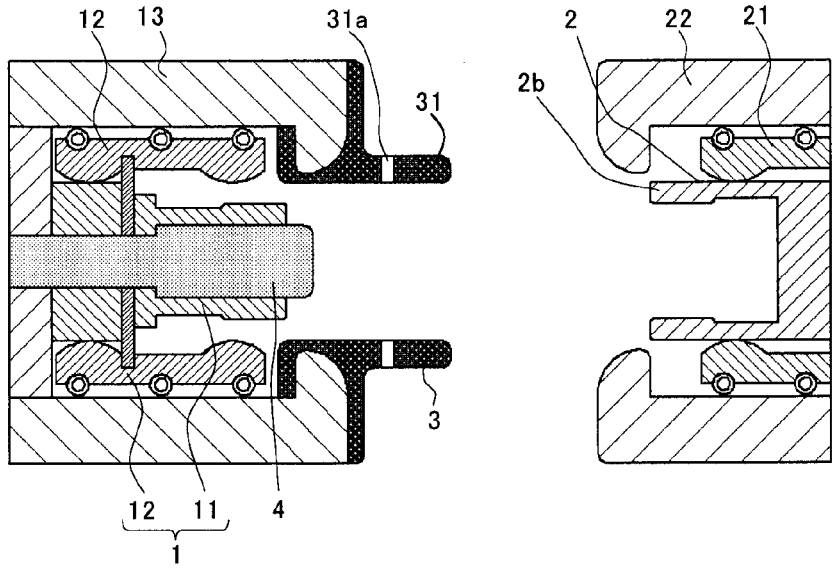
FIG. 8 is a sectional view showing a complete open contact state of Embodiment 1.

Next, the operation of the thus configured Embodiment 1 will be described with reference to FIG. 1, FIG. 2, FIG. 6, FIG. 7, and FIG. 8. Incidentally, FIG. 2 is a sectional view as viewed along the line II-II in FIG. 1. Furthermore, FIG. 6 is a sectional view showing a close contact state of FIG. 1; FIG. 7 is a sectional view showing a halfway open contact state at the time when the arc A is generated; and FIG. 8 is a sectional view showing a complete open contact state.

First, as shown in FIG. 6, in the case where the switchgear is in the close contact state, current is energized through the fixed main contact 12, the movable contactor 2, and the current collector 21. When a contact opening command is given to the switchgear, the movable contactor 2 is driven in the right direction in FIG. 1 by the driving device (not shown in the drawing). Accordingly, the movable contactor 2 is separated from the fixed main contact 12, and the current flown through the fixed main contact 12 is commuted to the fixed arc contact 11. When the open contact further proceeds, the movable contactor 2 is separated from the fixed contactor 11 in a temporally delayed manner and an arc A is generated.

FIG. 7 is a sectional view at the time when the movable contactor 2 is separated from the fixed arc contact 11 and the arc A is generated. When the arc A is generated between the fixed arc contact 11 and the movable contactor 2, the switchgear is in a state where the through hole 31*a* is blocked by the movable contactor 2; and therefore, the pressure of the arc space portion S surrounded by the movable contactor 2 and the arc extinction member 3 rises by the heat of the arc A.

The separation of the movable contactor 2 proceeds and the movable contactor 2 passes by the through holes 31*a*. Then, as shown in FIG. 1, in a state where the movable contactor 2 is in the surrounding portion 31 of the arc extinction member 3, risen high pressure gas in the arc space portion S is discharged from the through holes 31*a* to the inside of the tank (not shown in the drawing); and accordingly, there generates a pressure gradient which lowers from the central portion side of the arc extinction member 3 toward the inner wall surface side of the arc extinction member 3, the inner wall surface being formed with the through holes 31*a*, and the flow of gas is formed in the direction of dashed line arrow B in FIG. 2. The arc A extends to the inner wall surface side of the arc extinction member 3 in response to the flow of gas; and therefore, the arc A comes into contact with the inner circumferential surface of the surrounding portion 31 of the arc extinction member 3.

Accordingly, arc extinguishing gas is further stably generated in a great amount from the arc extinction member 3; and therefore, the arc A is decomposed or cooled by the arc extinguishing gas and interruption performance is improved. Furthermore, when the arc A comes into contact with the arc extinguishing member 4 provided in the central portion of the fixed arc contact 11, arc extinguishing gas is also generated from the arc extinguishing member 4; and accordingly, a pressure gradient is generated to form the flow of gas and the arc extinguishing gas acts so as to be blown to the arc A. Thus, a cooling effect on the arc A increases and the interruption performance is further improved. Finally, the leading end of the movable contactor 2 goes to the inside of the movable side shield 22 as shown in FIG. 8 to become the complete open contact state.

As described above, according to Embodiment 1, the configuration is made such that the arc extinction member 3 includes the surrounding portion 31 which is slidably connected to the outer circumferential surface 2*a* of the movable contactor 2 halfway in the movement range from the close contact state to the open contact state, and the surrounding portion 31 is formed with the through hole 31*a* for deflecting the direction of the generated arc in the direction of the inner circumferential surface of the surrounding portion 31 by the pressure gradient; and therefore, the extending direction of the arc A is controlled by the pressure gradient generated inside the surrounding portion 31 and the arc can be surely brought into contact with the arc extinction member 3. Thus, the arc extinguishing gas is stably generated and arc extinguishing performance of the switchgear can be improved. Furthermore, it also becomes possible to achieve a reduction in size of the device and to reduce environmental load by the improvement of the arc extinguishing performance.

Further, the arc is brought into contact with the arc extinction member 3 and is cooled by utilizing the pressure rise due to the heat of the arc; and therefore, time in which the arc is controlled depends on the pressure. That is, even in the case of reaching near a current zero point, the arc continues to come into contact with the arc extinguishing member and the stable generation of the arc extinguishing gas can be expected. Whereas, in the case of controlling the extending direction of the arc by utilizing electromagnetic force, the time in which the arc is controlled is determined by current. Thus, the electromagnetic force reduces near the current zero point and accordingly the arc is likely not to come into contact with the arc extinction member; and therefore, the stable generation of the arc extinguishing gas cannot be expected.

Embodiment 2

Figure 3:
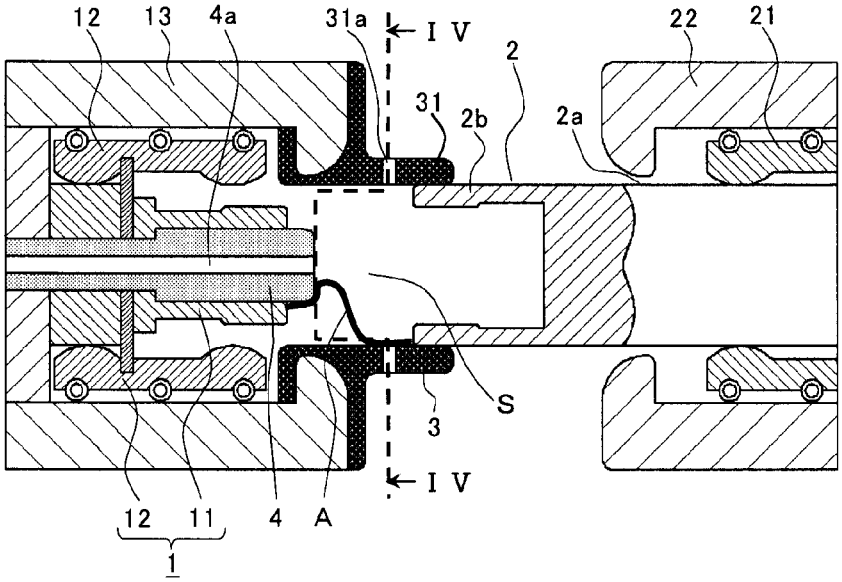
FIG. 3 is a sectional view conceptually showing a major portion of a switchgear according to Embodiment 2 of the present invention.
Figure 4:
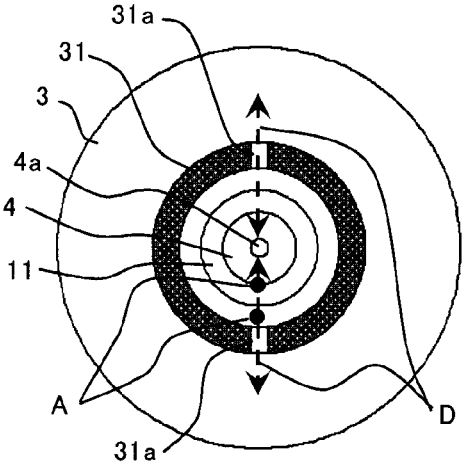
FIG. 4 is a sectional view as viewed along the line IV-IV in FIG. 3.

FIG. 3 is a sectional view conceptually showing a major portion of a switchgear according to Embodiment 2 of the present invention; and FIG. 4 is a sectional view as viewed along the line IV-IV in FIG. 3. In the drawings, a through hole 4*a* is axially formed in a central portion of an arc extinguishing member 4. An arc extinction chamber formed by an arc extinction member 3 communicates with a space in a tank (not shown in the drawing) filled with insulating gas by the through hole 4*a*. The other configuration is similar to that of the above Embodiment 1.

In the thus configured Embodiment 2, when an arc A is generated, a pressure gradient is generated by the heat of the arc A, the pressure gradient being lowered from the center side of an arc space portion S to the direction of the through hole 4*a* in the central portion of the arc extinguishing member 4 and two directions toward through holes 31*a* of a surrounding portion 31; and the flow of gas is formed in the direction of dashed line arrow D in FIG. 4.

A part of the arc A, which exists on the fixed arc contact 11 side, extends to the outer circumferential surface side of the arc extinguishing member 4 in response to the flow of gas and comes into contact with the arc extinguishing member 4. Whereas, a part of the arc A, which exists on the movable contactor 2 side, comes into contact with the inner circumferential surface of the arc extinction member 3 in response to the flow of gas, as in Embodiment 1. Therefore, the arc A can be brought into contact with both the arc extinguishing member 4 and the arc extinction member 3 and the amount of generation of arc extinguishing gas can be increased; and thus, interruption performance is further improved.

Embodiment 3

Figure 5:
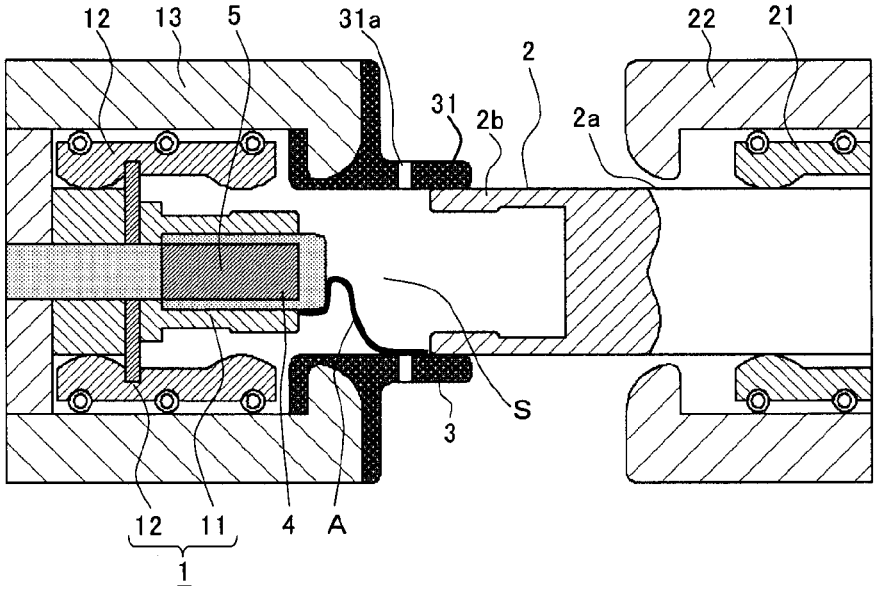
FIG. 5 is a sectional view conceptually showing a major portion of a switchgear according to Embodiment 3 of the present invention.

FIG. 5 is a sectional view conceptually showing a major portion of a switchgear according to Embodiment 3 of the present invention. In the drawing, permanent magnets 5 are provided so as to be embedded at a central portion of an arc extinguishing member 4. The permanent magnets 5 are arranged in an axial direction, that is, along the driving direction of a movable contactor 2 in the direction of N- and S-poles, or S- and N-poles. The other configuration is similar to that of Embodiment 1. Incidentally, the permanent magnets 5 may be integrally embedded in the arc extinguishing member 4, or may be separately configured and incorporated in the arc extinguishing member 4 in assembling.

In the thus configured Embodiment 3, an arc A performs rotational motion in response to circumferential force due to a magnetic field by the permanent magnets 5. That is, the arc A is driven in the rotational direction on an electrode, that is, a fixed arc contact 11; and therefore, interruption performance is improved by the temperature suppression of the electrode and the cooling effect of forced-convection. At the same time, the arc A is characterized by extending so as to conform with a longitudinal magnetic field of the permanent magnets 5, that is, a magnetic field in the separating direction of the movable contactor 2; and the arc A is pulled by the permanent magnets 5.

In the case of Embodiment 3, the permanent magnets 5 are covered around by the arc extinguishing member 4 for protection; and therefore, the arc A pulled by the permanent magnets 5 stably comes into contact with the arc extinguishing member 4. That is, a part of the arc A, which exists on the fixed arc contact 11 side, remains in a state where the part of the arc A comes into contact with the arc extinguishing member 4; whereas a part of the arc A, which exists on the movable contactor 2 side, remains in a state where the latter part of the arc A comes into contact with the arc extinction member 3. Therefore, the arc A can be brought into contact with both the arc extinguishing member 4 and the arc extinction member 3 and the amount of generation of arc extinguishing gas can be increased; and thus, interruption performance can be further improved.

Embodiment 4

Figure 13:
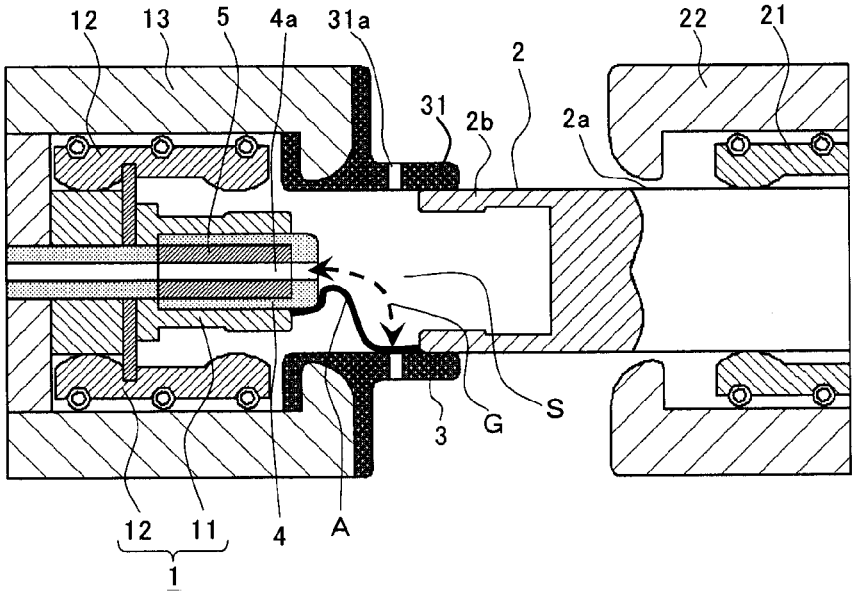
FIG. 13 is a sectional view conceptually showing a major portion of a switchgear according to Embodiment 4 of the present invention.

FIG. 13 is a sectional view conceptually showing a major portion of a switchgear according to Embodiment 4 of the present invention. In the drawing, a through hole 4*a* axially passing through a central portion of an arc extinguishing member 4 and a central portion of permanent magnets 5 is formed. An arc extinction chamber formed by an arc extinction member 3 communicates with a space in a tank (not shown in the drawing) filled with insulating gas by the through hole 4*a*. The other configuration is similar to that of Embodiment 3.

In the thus configured Embodiment 4, when an arc A is generated, a pressure gradient is generated by the heat of the arc A, the pressure gradient being lowered from the center side of an arc space portion S to the direction of the through hole 4*a* in the central portion of the arc extinguishing member 4 and two directions toward through holes 31*a* of a surrounding portion 31; and the flow of gas is formed in the direction of dashed line arrow G in FIG. 13.

A part of the arc A, which exists on the fixed arc contact 11 side, extends to the outer circumferential surface side of the arc extinguishing member 4 in response to the flow of gas and comes into contact with the arc extinguishing member 4. Further, the part of the arc A comes into contact with the arc extinguishing member 4 more surely by characteristics in which the arc A extends so as to conform with a longitudinal magnetic field of the permanent magnets 5. Whereas, a part of the arc A, which exists on the movable contactor 2 side, comes into contact with the inner circumferential surface of the arc extinction member 3 in response to the flow of gas, as in Embodiment 1. Therefore, the arc A can be brought into contact with both the arc extinguishing member 4 and the arc extinction member 3 and the amount of generation of arc extinguishing gas can be increased; and thus, interruption performance is further improved.

Embodiment 5

Figure 14:
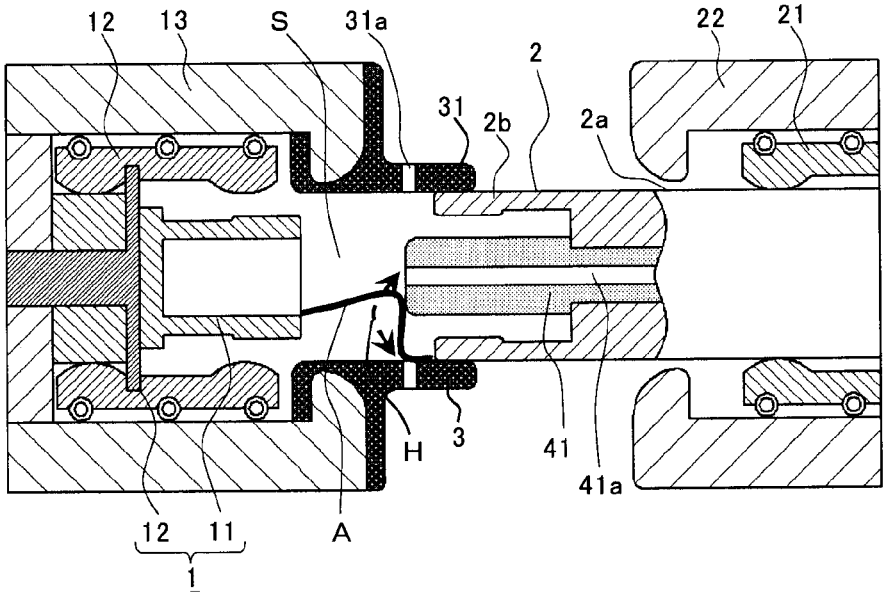
FIG. 14 is a sectional view conceptually showing a major portion of a switchgear according to Embodiment 5 of the present invention.

FIG. 14 is a sectional view conceptually showing a major portion of a switchgear according to Embodiment 5 of the present invention. In the drawing, an arc extinguishing member 41 is provided in a central portion of a movable contactor 2. A through hole 41*a* axially passing through a central portion of the arc extinguishing member 41 is formed; and an arc extinction chamber formed by an arc extinction member 3 communicates with a space in a tank (not shown in the drawing) filled with insulating gas by the through hole 41*a*. The other configuration is similar to that of Embodiment 2.

In the thus configured Embodiment 5, when an arc A is generated, a pressure gradient is generated by the heat of the arc A, the pressure gradient being lowered from the center side of an arc space portion S to the direction of the through hole 41*a* in the central portion of the arc extinguishing member 41 and two directions toward through holes 31*a* of a surrounding portion 31; and the flow of gas is formed in the direction of dashed line arrow H in FIG. 14.

A part of the arc A, which exists on the fixed arc contact 11 side, comes into contact with the outer circumferential surface of the arc extinguishing member 41 and the inner circumferential surface of the arc extinction member 3 in response to the flow of gas. Therefore, the arc A can be brought into contact with both the arc extinguishing member 41 and the arc extinction member 3 and the amount of generation of arc extinguishing gas can be increased, as in the above Embodiment 2; and thus, interruption performance is further improved.

Embodiment 6

Figure 15:
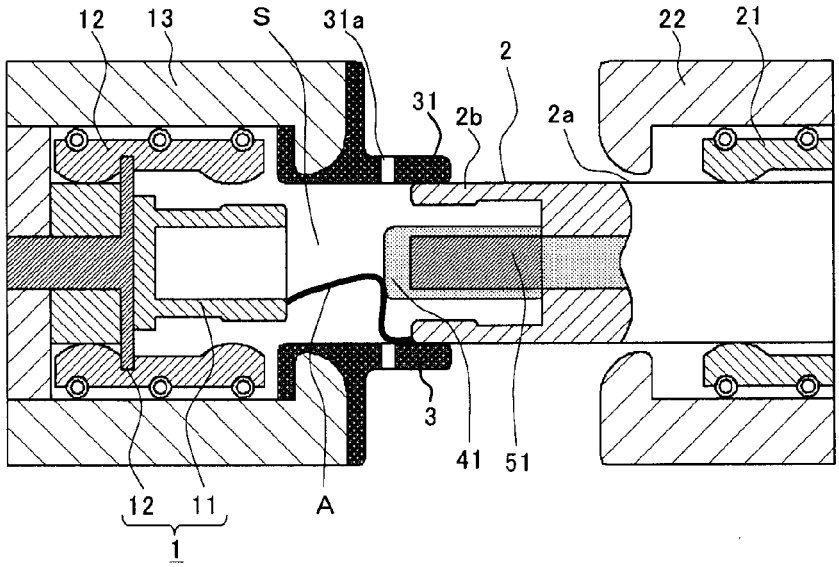
FIG. 15 is a sectional view conceptually showing a major portion of a switchgear according to Embodiment 6 of the present invention.

FIG. 15 is a sectional view conceptually showing a major portion of a switchgear according to Embodiment 6 of the present invention. In the drawing, an arc extinguishing member 41 is provided in a central portion of a movable contactor 2. Permanent magnets 51 are provided so as to be embedded at a central portion of the arc extinguishing member 41. The permanent magnets 51 are arranged in an axial direction, that is, along the driving direction of the movable contactor 2 in the direction of N- and S-poles, or S- and N-poles. The other configuration is similar to that of Embodiment 3. Incidentally, the permanent magnets 51 may be integrally embedded in the arc extinguishing member 41, or may be separately configured and incorporated in the arc extinguishing member 41 in assembling.

In the thus configured Embodiment 6, an arc A performs rotational motion in response to circumferential force due to a magnetic field by the permanent magnets 51. That is, the arc A is driven in the rotational direction on an electrode, that is, the movable contactor 2; and therefore, interruption performance is improved by the temperature suppression of the electrode and the cooling effect of forced-convection. At the same time, the arc A is characterized by extending so as to conform with a longitudinal magnetic field of the permanent magnets 51, that is, a magnetic field in the separating direction of the movable contactor 2; and the arc A is pulled by the permanent magnets 51.

The permanent magnets 51 are covered around by the arc extinguishing member 41 for protection; and therefore, the arc A pulled by the permanent magnets 51 stably comes into contact with the arc extinguishing member 41. Therefore, the arc A can be brought into contact with both the arc extinguishing member 41 and the arc extinction member 3 and the amount of generation of arc extinguishing gas can be increased, as in the above Embodiment 3; and thus, interruption performance is further improved.

Embodiment 7

Figure 16:
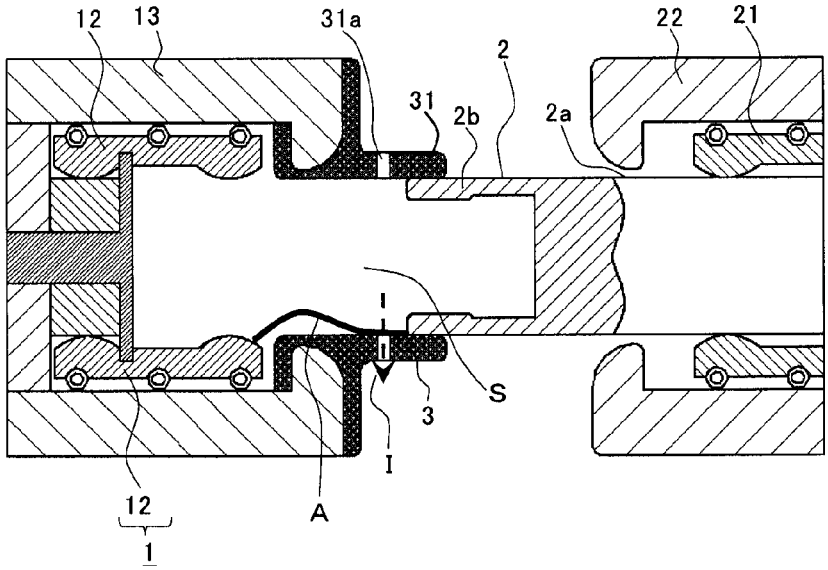
FIG. 16 is a sectional view conceptually showing a major portion of a switchgear according to Embodiment 7 of the present invention.

FIG. 16 is a sectional view conceptually showing a major portion of a switchgear according to Embodiment 7 of the present invention. In the drawing, a fixed contactor 1 is made up by only a fixed main contact 12. The other configuration is similar to that of the above Embodiment 1.

In the thus configured Embodiment 7, when an arc A is generated between the fixed main contact 12 and a movable contactor 2, a pressure gradient is generated by the heat of the arc A, the pressure gradient being lowered from the center side of an arc space portion S to two directions toward through holes 31*a* of a surrounding portion 31; and the flow of gas is formed in the direction of dashed line arrow I in FIG. 16.

The arc A comes into contact with the inner circumferential surface of the arc extinction member 3 in response to the flow of gas, as in Embodiment 1. Therefore, the arc A can be surely brought into contact with the arc extinction member 3 and the amount of generation of arc extinguishing gas can be increased, as in the above Embodiment 1; and thus, interruption performance is further improved.

Embodiment 8

Figure 17:
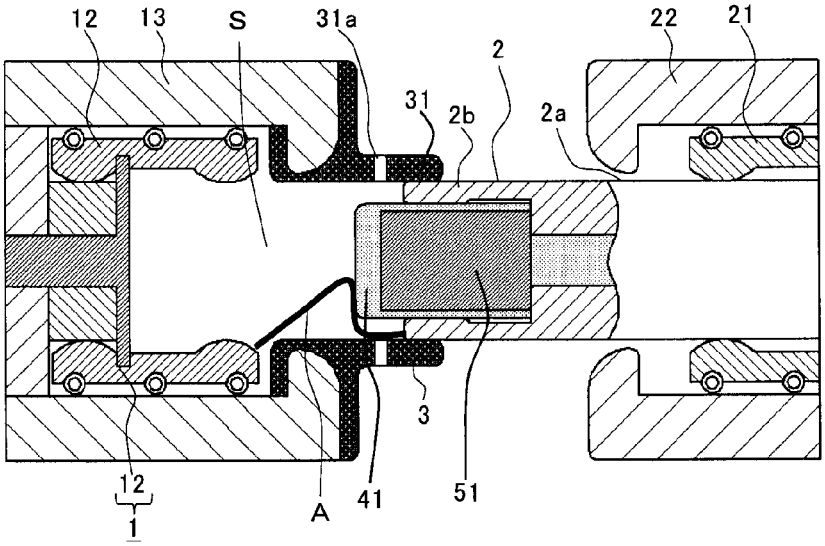
FIG. 17 is a sectional view conceptually showing a major portion of a switchgear according to Embodiment 8 of the present invention.

FIG. 17 is a sectional view conceptually showing a major portion of a switchgear according to Embodiment 8 of the present invention. In the drawing, a fixed contactor 1 is made up by only a fixed main contact 12. Furthermore, an arc extinguishing member 41 is provided in a central portion of a movable contactor 2. Permanent magnets 51 are provided so as to be embedded at a central portion of the arc extinguishing member 41. The permanent magnets 51 are arranged in an axial direction, that is, along the driving direction of the movable contactor 2 in the direction of N- and S-poles, or S- and N-poles. The other configuration is similar to that of Embodiment 7. Incidentally, the permanent magnets 51 may be integrally embedded in the arc extinguishing member 41, or may be separately configured and incorporated in the arc extinguishing member 41 in assembling.

In the thus configured Embodiment 8, an arc A is generated between the fixed main contact 12 and the movable contactor 2. The arc A performs rotational motion in response to circumferential force due to a magnetic field by the permanent magnets 51. That is, the arc A is driven in the rotational direction on an electrode, that is, the movable contactor 2; and therefore, interruption performance is improved by the temperature suppression of the electrode and the cooling effect of forced-convection.

At the same time, the arc A is characterized by extending so as to conform with a longitudinal magnetic field of the permanent magnets 51, that is, a magnetic field in the separating direction of the movable contactor 2; and the arc A is pulled by the permanent magnets 51. The permanent magnets 51 are covered around by the arc extinguishing member 41 for protection; and therefore, the arc A pulled by the permanent magnets 51 stably comes into contact with the arc extinguishing member 41. Therefore, the arc A can be brought into contact with both the arc extinguishing member 41 and the arc extinction member 3 and the amount of generation of arc extinguishing gas can be increased, as in Embodiment 3; and thus, interruption performance is further improved.

Furthermore, the fixed arc contact 11 does not exist; and therefore, the arc extinguishing member 41 and the permanent magnets 51 can be increased in size. Thus, the contact probability of the arc extinguishing member 41 can be raised, it becomes possible to enhance the magnetic flux density of the permanent magnets 51, and the amount of generation of arc extinguishing gas can be increased; and therefore, interruption performance can be further improved.

Embodiment 9

Figure 18:
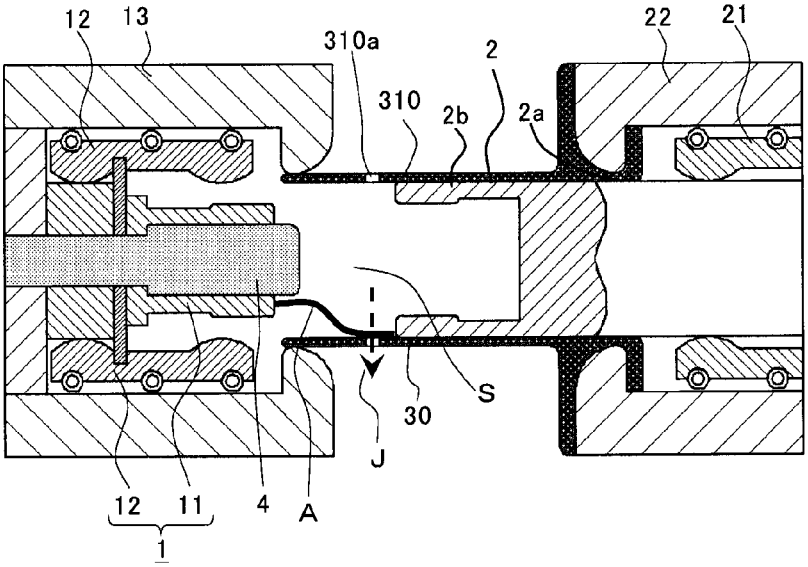
FIG. 18 is a sectional view conceptually showing a major portion of a switchgear according to Embodiment 9 of the present invention.

FIG. 18 is a sectional view conceptually showing a major portion of a switchgear according to Embodiment 9 of the present invention. In the drawing, an arc extinction member 30 has a surrounding portion 310 which is slidably connected to the outer circumferential surface 2*a* of a movable contactor 2 halfway in a movement range from a close contact state to an open contact state. The surrounding portion 310 is formed so as to surround an arc space portion S in a sealed manner and is fixed to a movable side shield 22. Then, the surrounding portion 310 slidably connected to the outer circumferential surface of the movable contactor 2 is formed so as to extend toward a fixed contactor 1. The other configuration is similar to that of the above Embodiment 1.

In the thus configured Embodiment 9, when an arc A is generated, a pressure gradient is generated by the heat of the arc A, the pressure gradient being lowered from the center side of the arc space portion S to the directions toward through holes 310*a* of the surrounding portion 310; and the flow of gas is formed in the direction of dashed line arrow J in FIG. 18. The arc A comes into contact with the inner circumferential surface of the arc extinction member 30 in response to the flow of gas. Thus, the amount of generation of arc extinguishing gas can be increased, as in the above Embodiment 1; and therefore, interruption performance is improved.

Embodiment 10

Figure 19:
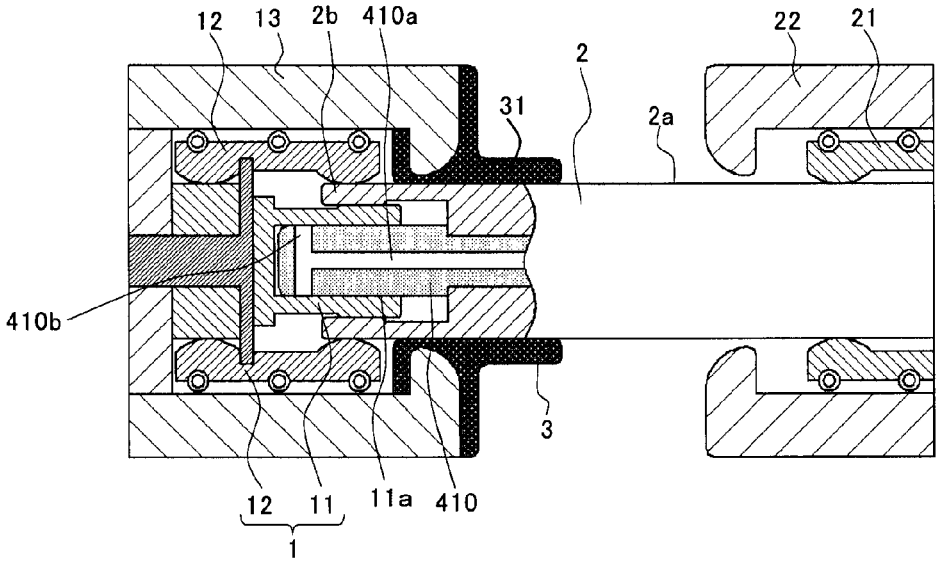
FIG. 19 is a sectional view showing a close contact state of Embodiment 10 of the present invention.

FIG. 19 is a sectional view of a close contact state conceptually showing a major portion of a switchgear according to Embodiment 10 of the present invention. In the drawing, an arc extinguishing member 410 is provided in a central portion of a movable contactor 2 and the outer circumferential surface of the arc extinguishing member 410 is formed so as to be slidably connected to the inner circumferential surface 11*a* of a fixed arc contact 11. A axially formed center hole 410*a* is formed in a central portion of the arc extinguishing member 410; and a radially formed through hole 410*b* communicating with the center hole 410*a* is formed at an end portion on the fixed contactor side of the arc extinguishing member 410. An arc extinction chamber formed by the arc extinction member 3 communicates with a space in a tank (not shown in the drawing) filled with insulating gas by the center hole 410*a* and the through hole 410*b*.

Furthermore, an arc extinction member 3 constituting the arc extinction chamber is fixed to the fixed side shield 13 side and has a surrounding portion 31 which is slidably connected to the outer circumferential surface 2*a* of the movable contactor 2 halfway in a movement range from a close contact state to an open contact state, the surrounding portion 31 being formed so as to surround an arc space portion S in a sealed manner. The through hole 31*a* exists at a predetermined portion of the surrounding portion 31 of the arc extinction member 3 in Embodiment 1 to Embodiment 9; however, the through hole 31*a* does not exist in this Embodiment 10. The other configuration is similar to that of Embodiment 1.

Hereinafter, the operation of the switchgear according to Embodiment 10 of the present invention will be described with reference to FIG. 19, FIG. 20, and FIG. 21. Incidentally, FIG. 20 is a sectional view showing a halfway open contact state at the time when an arc A is generated; and FIG. 21 is a sectional view showing a halfway open contact state at the time when the through hole 410*b* is opened.

In the thus configured Embodiment 10, first, in the case where the switchgear is in the close contact state as shown in FIG. 19, current is energized through the fixed main contact 12, the movable contactor 2, and a current collector 21. When a contact opening command is given to the switchgear, the movable contactor 2 is driven in the right direction of FIG. 19 by a driving device (not shown in the drawing). Accordingly, the movable contactor 2 is separated from the fixed main contact 12, and the current flown through the fixed main contact 12 is commuted to the fixed arc contact 11. When the open contact further proceeds, the movable contactor 2 is separated from the fixed contactor 11 in a temporally delayed manner and an arc A will be generated.

Figure 20:
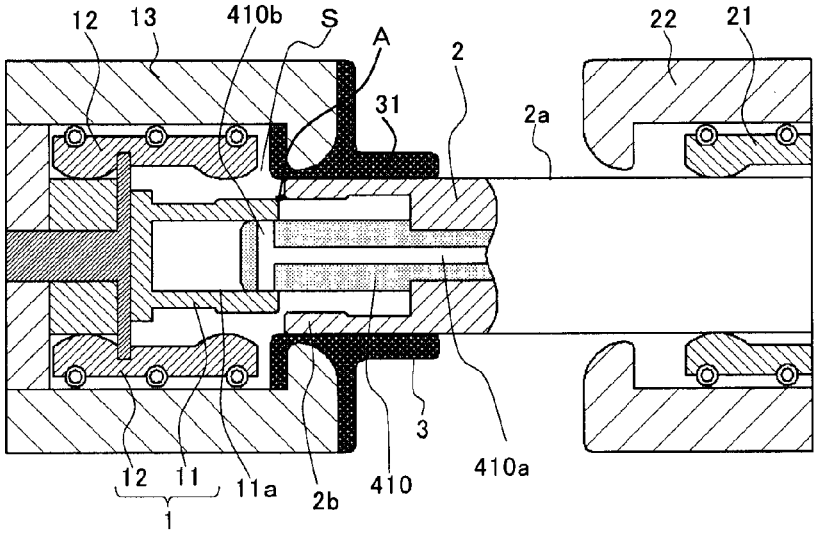
FIG. 20 is a sectional view showing a halfway open contact state at the time when an arc is generated in Embodiment 10.
Figure 21:
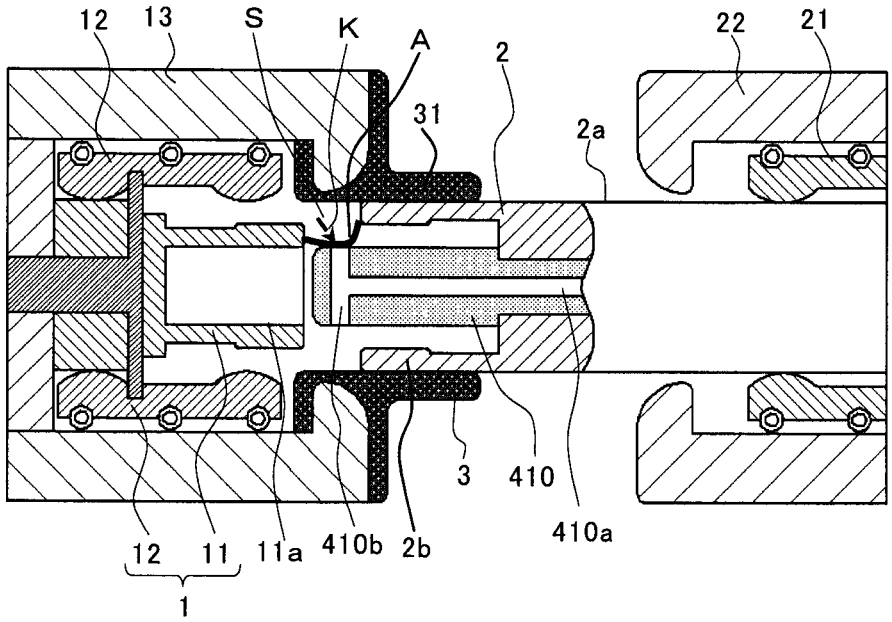
FIG. 21 is a sectional view showing a halfway open contact state at the time when a gas flow is formed in Embodiment 10.

FIG. 20 is the sectional view at the time when the movable contactor 2 is separated from the fixed arc contact 11 and the arc A is generated. When the arc A is generated between the fixed arc contact 11 and the movable contactor 2, the switchgear is in a state where the through hole 410*b* is blocked by the fixed arc contact 11; and therefore, the pressure of the arc space portion S surrounded by the movable contactor 2 and the arc extinction member 3 rises by the heat of the arc A.

The separation of the movable contactor 2 proceeds and the movable contactor 2 passes by the through holes 410*b*. Then, in a state where the movable contactor 2 is in the surrounding portion 31 of the arc extinction member 3 as shown in FIG. 21, risen high pressure gas in the arc space portion S is discharged from the through holes 410*b* to the inside of the tank (not shown in the drawing); and accordingly, there generates a pressure gradient which lowers from the central portion side of the arc extinction member 3 toward the through hole 410*b* of the arc extinguishing member 410, and the flow of gas is formed in the direction of dashed line arrow K in FIG. 21. The arc A extends to the direction of the outer circumferential surface of the arc extinguishing member 410 in response to the flow of gas; and therefore, the arc A comes into contact with the arc extinguishing member 410.

Accordingly, arc extinguishing gas is stably generated in a great amount from the arc extinguishing member 410; and therefore, the arc A is decomposed or cooled by the arc extinguishing gas and interruption performance is improved. Furthermore, when the arc A comes into contact with the arc extinguishing member 410 provided in the central portion of the fixed arc contact 11, arc extinguishing gas is also generated from the arc extinguishing member 410; and accordingly, a pressure gradient is generated to form the flow of gas and the arc extinguishing gas acts so as to be blown to the arc A. Thus, a cooling effect on the arc A increases and the interruption performance is further improved.

Incidentally, the number of the through holes 410*b* and their circumferential placing positions are not particularly limited, but it is permissible if the arc A can be extended to the outer circumferential surface of the arc extinguishing member 410 by the pressure gradient which is generated in connection with the generation of the arc A and lowers from the center side of the arc space portion S toward the through hole 410*b*, at least one place; and the through holes 410*b* do not also need to be arranged in a line-symmetric manner.

INDUSTRIAL APPLICABILITY

The present invention is suitable for achieving a highly reliable switchgear in which an arc space communicates with the outside of the arc space by a through hole formed in a surrounding portion of an arc extinction member, thereby being capable of controlling the extending direction of an arc so as to be surely brought into contact with the arc extinction member.

The invention claimed is:

1. A switchgear comprising:

a fixed contactor provided in a tank filled with insulating gas;

a movable contactor provided in said tank, said movable contactor being connected to and disconnected from said fixed contactor so as to move forward and backward; and an arc extinction member including a surrounding portion which is slidably connected to the outer circumferential surface of said movable contactor halfway in a movement range from a close contact state to an open contact state, and is formed so as to surround an arc space portion in a sealed manner, the surrounding portion being formed with a through hole through which the arc space communicates with the inside of said tank filled with insulating gas.

2. The switchgear according to claim 1, wherein said fixed contactor is composed of:

a cylindrically shaped fixed arc contact provided in a central portion thereof; and a fixed main contact disposed on an outer circumferential portion of said fixed arc contact via a gap, said arc extinction member is fixed to a fixed side shield on the separating direction side of said movable contactor, said fixed side shield being formed so as to surround said fixed main contact, and the surrounding portion, which is slidably connected to the outer circumferential surface of said movable contactor, is formed so as to extend in the separating direction of said movable contactor.

3. The switchgear according to claim 2, wherein the through hole is formed at least one in number in the surrounding portion, the through hole being blocked by said movable contactor in the close contact state, and the through hole being opened when said movable contactor is separated from said fixed arc contact and then moves a predetermined distance inside the surrounding portion.

4. The switchgear according to claim 2, further comprising:

an arc extinguishing member in a central portion of said fixed arc contact.

5. The switchgear according to claim 4, wherein said arc extinguishing member is formed with a through hole axially passing through a central portion thereof.

6. The switchgear according to claim 4, wherein said arc extinguishing member further protrudes from an end portion of said fixed arc contact in the separating direction of said movable contactor.

7. The switchgear according to claim 5, wherein said arc extinguishing member further protrudes from an end portion of said fixed arc contact in the separating direction of said movable contactor.

8. The switchgear according to claim 2, further comprising:

permanent magnets whose magnetic poles are provided so as to be disposed in the separating direction of said movable contactor at a central portion of said fixed arc contact.

9. The switchgear according to claim 1, wherein the through hole is such that the diameter of the outer circumferential surface side of said arc extinction member is larger than the diameter of the inner circumferential surface side thereof.

10. The switchgear according to claim 4, further comprising:

permanent magnets whose magnetic poles are provided so as to be disposed in the separating direction of said movable contactor at a central portion of said arc extinguishing member, said arc extinguishing member and said permanent magnets being formed with a through hole axially passing through a central portion thereof.

11. The switchgear according to claim 5, further comprising:

permanent magnets whose magnetic poles are provided so as to be disposed in the separating direction of said movable contactor at a central portion of said arc extinguishing member, said arc extinguishing member and said permanent magnets being formed with a through hole axially passing through a central portion thereof.

12. The switchgear according to claim 1, further comprising:

an arc extinguishing member in a central portion of said movable contactor.

13. The switchgear according to claim 3, further comprising:

an arc extinguishing member in a central portion of said movable contactor.

14. The switchgear according to claim 12, wherein said arc extinguishing member is formed with a through hole axially passing through a central portion thereof.

15. The switchgear according to claim 14, further comprising:

permanent magnets whose magnetic poles are provided so as to be disposed in the separating direction of said movable contactor at a central portion of said arc extinguishing member.

16. The switchgear according to claim 11, wherein said fixed contactor is made up of a fixed main contact.

17. The switchgear according to claim 16, further comprising:

an arc extinguishing member in a central portion of said movable contactor; and permanent magnets whose magnetic poles are provided so as to be disposed in the separating direction of said movable contactor at a central portion of said arc extinguishing member.

18. The switchgear according to claim 1, wherein said fixed contactor is composed of:

a cylindrically shaped fixed arc contact provided in a central portion thereof; and a fixed main contact disposed on an outer circumferential portion of said fixed arc contact via a gap, said arc extinction member is fixed to a movable side shield on the fixed contactor side, said movable side shield being formed so as to surround said movable contactor, and the surrounding portion, which is slidably connected to the outer circumferential surface of said movable contactor, is formed so as to extend toward said fixed contactor.

19. A switchgear comprising:

a fixed contactor provided in a tank filled with insulating gas;

a movable contactor provided in said tank, said movable contactor being connected to and disconnected from said fixed contactor so as to move forward and backward;

an arc extinction member having a surrounding portion which is slidably connected to the outer circumferential surface of said movable contactor halfway in a movement range from a close contact state to an open contact state, and is formed so as to surround an arc space portion in a sealed manner; and an arc extinguishing member provided in a central portion of said movable contactor, said arc extinguishing member being formed with a center hole axially formed in a central portion of said arc extinguishing member, wherein the arc space communicates with the inside of said tank filled with insulating gas through said center hole.

20. The switchgear according to claim 19, wherein said arc extinguishing member is formed with a through hole which communicates with the center hole, the through hole being formed at end portion of said arc extinguishing member on the fixed contactor side.

* * * * *